US010349735B2

(12) United States Patent
Dvorchak

(10) Patent No.: US 10,349,735 B2
(45) Date of Patent: Jul. 16, 2019

(54) SCRAPE AND SWEEP BROOM HANDLE ATTACHMENT

(71) Applicant: Keith Edward Dvorchak, New Salem, PA (US)

(72) Inventor: Keith Edward Dvorchak, New Salem, PA (US)

( * ) Notice: Subject to any disclaimer, the term of this patent is extended or adjusted under 35 U.S.C. 154(b) by 346 days.

(21) Appl. No.: 15/398,703

(22) Filed: Jan. 4, 2017

(65) Prior Publication Data

US 2017/0188774 A1 Jul. 6, 2017

Related U.S. Application Data

(60) Provisional application No. 62/387,678, filed on Jan. 4, 2016.

(51) Int. Cl.
*A46B 17/08* (2006.01)
*A47L 13/08* (2006.01)
(Continued)

(52) U.S. Cl.
CPC ..... *A46B 17/08* (2013.01); *A46B 15/0081* (2013.01); *A47L 13/08* (2013.01);
(Continued)

(58) Field of Classification Search
CPC ..... A46B 15/0081; A46B 17/00; A46B 17/08; A46B 2200/302; A47L 13/02;
(Continued)

(56) References Cited

U.S. PATENT DOCUMENTS 412,002 A * 10/1889 Schroen ..... 15/246
688,160 A * 12/1901 Clarke ..... 15/246
(Continued)

*Primary Examiner* — Mark Spisich
(74) *Attorney, Agent, or Firm* — Chen-Chi Lin

(57) ABSTRACT

The Scrape and Sweep Broom Handle Attachment is a scraping tool with special features that allow it to be quickly attached to the ends of broom and mop handles, so it doubles the effectiveness of brooms and mops as cleaning tools. Brooms and mops are some of the most commonly used cleaning tools in the world because they are highly effective at removing loose debris from floors; but when wet food and dirt dry and become stuck to floors, it often becomes necessary for people who are sweeping or mopping those floors to stop, then find other tools and get down on their hands and knees to scrape the stuck-on food and dirt loose, and then resume sweeping or mopping. When a person has a Scrape and Sweep Broom Handle Attachment on the end of their broom or mop handle though, it's not necessary for them to find another tool and get down on the floor; that person may simply turn their broom or mop around, remain standing, scrape off whatever is stuck, and then sweep or mop it away. The Scrape and Sweep Broom Handle Attachment can be quickly and easily removed from broom and mop handles to be used on raised surfaces also, such as countertops, tables, walls and windows. Because the Scrape and Sweep Broom Handle Attachment enables people to clean up faster and with less effort than when using a broom, soapy rag, sponge, or mop alone, and because it helps people maintain a greater degree of comfort while cleaning floors, it is likely to become as commonly used as brooms and mops themselves.

1 Claim, 1 Drawing Sheet

Top View

(51) Int. Cl.
*A47L 13/50* (2006.01)
*A46B 15/00* (2006.01)
*B08B 1/00* (2006.01)

(52) U.S. Cl.
CPC ..... *A47L 13/50* (2013.01); *B08B 1/005* (2013.01); *A46B 2200/302* (2013.01)

(58) Field of Classification Search
CPC ..... A47L 13/08; A47L 13/12; A47L 17/06; B08B 1/005; B44D 3/162; B44D 3/164; B60S 3/045; E01H 1/12; E01H 5/02; E01H 5/12
USPC ..... 15/105, 111, 113, 236.01, 236.02, 246; 30/169; D4/118; D32/40, 42, 46, 48, 49, D32/50, 51
See application file for complete search history.

(56) References Cited

U.S. PATENT DOCUMENTS 1,018,518 A * 2/1912 Pettit ..... A47L 11/4038 15/236.01
2,506,083 A * 5/1950 Hollander ..... A47L 13/08 30/169
D239,480 S * 4/1976 Thomas ..... D4/118
2015/0052700 A1* 2/2015 Dvorchak ..... A46B 15/0055 15/236.01

* cited by examiner

FIG. 1 Top View
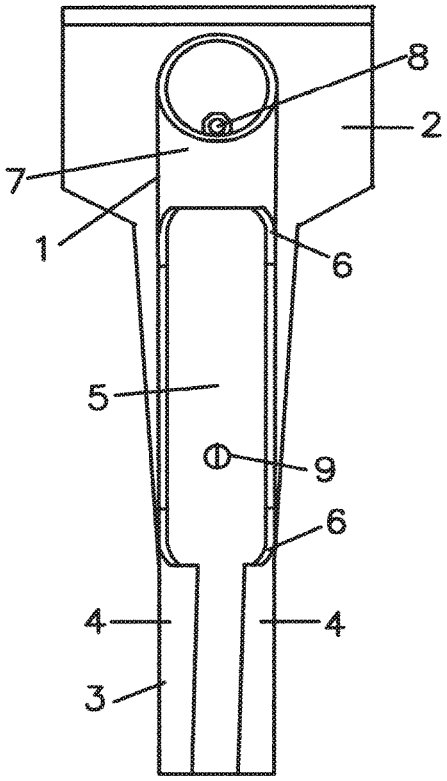
FIG. 2 Side View
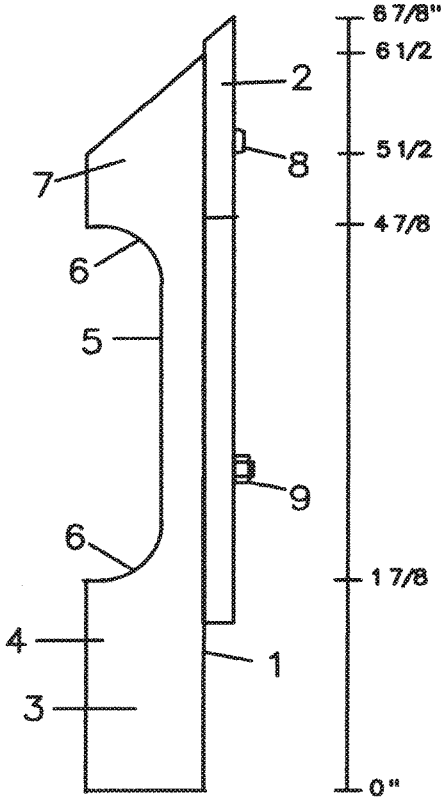
FIG. 3 Front View
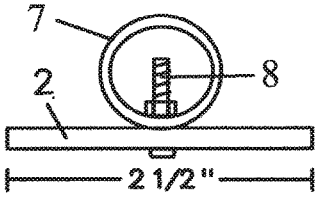

SCRAPE AND SWEEP BROOM HANDLE ATTACHMENT

CROSS-REFERENCE TO RELATED APPLICATIONS

Application No. 62/387,678; Filing date: Jan. 4, 2016.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISK APPENDIX

Not Applicable.

BACKGROUND OF THE INVENTION

The Scrape and Sweep Broom Handle Attachment was created to decrease the time and effort used when completing tasks associated with household cleanup. The need for such a device was discovered as the inventor's child was learning to feed herself with a spoon, eating apple sauce and crisped rice cereal. Often the child would drop these foods on the floor. Sometimes these accidents would go unnoticed until after the food had dried. The inventor would then find himself kneeling on the kitchen floor, scraping off dried-up applesauce and crisped rice cereal with a butter knife, so he could sweep these things into a dust pan and begin mopping. One winter morning, he tried using a plastic ice scraper and discovered this was much better than using a metal knife because he could also use the plastic blade to scrape off any dried food he found on the kitchen table, stove, and surrounding countertop, without scratching those surfaces. The idea came to the inventor to tape the ice scraper to the end of his broom handle, so he would not have to kneel down on the floor; but then it was too difficult to use the blade on the table, stove and countertop. The inventor then created a self-adjusting tubular handle from a length of PVC pipe, which was then attached to the ice scraper with screws, so that the tubular handle and the ice scraper formed one device. The shape and features of this device, allowed it to be quickly attached to and removed from, the ends of broom or mop handles of varying widths, while preventing the broom and mop handles from sliding through it or slipping out of its grip. That is how the Scrape and Sweep came into being.

BRIEF SUMMARY OF THE INVENTION

The Scrape and Sweep Broom Handle Attachment is a cleaning tool that is designed to be attached to the ends of broom or mop handles of varying widths; the end opposite of a broom's brush or of a mop's head. This device consists of a scraping blade and a uniquely designed self-adjusting tubular handle—known as the Tubular Body, which is considered by the inventor to be the most important component of the Scrape and Sweep Broom Handle Attachment. The physical features of the Tubular Body have been deliberately designed and shaped, so that one Scrape and Sweep Broom Handle Attachment may be easily and quickly attached to and removed from nearly every size of broom and mop handle that a person or family might have in their home, which allows those brooms and mops to become long-handled scrapers when the device is attached. When the device is removed, it may conveniently be used as a short handheld scraper in areas where the longer broom or mop handle gets in the way or is ineffective. The Scrape and Sweep Broom Handle Attachment has also been designed to remain firmly in place when attached to the ends of broom and mop handles and used to scrape debris from floors, because the pressure applied to the scraping blade causes the entire device to better grip the ends of those broom and mop handles. The Scrape and Sweep Broom Handle Attachment helps people avoid having to get on their hands and knees to clean floors, and further benefits its users by enabling them to remove dried-up, stuck-on messes from other surfaces faster, while using less effort, than when using only a soapy wet rag, sponge or mop.

BRIEF DESCRIPTION OF THE SEVERAL VIEWS OF THE DRAWINGS

This non-provisional patent application contains one page of drawings. The drawings depict one form or model of the Scrape and Sweep Broom Handle Attachment, which is known as Model 1. The drawings show different views, identified as FIG. 1 (FIG. 1 Top View) through FIG. 3 (FIG. 3 Front View) and each view is described in the following list:

FIG. 1—(FIG. 1 Top View) illustrates the appearance of Model 1 when viewed from above, and the bottom of the Scraping Blade (2) is turned down and parallel to the floor.

FIG. 2—(FIG. 2 Side View) illustrates the appearance of Model 1 when viewed with the right side up, and the bottom of the Scraping Blade (2) turned perpendicular to the floor. Displayed to the right of FIG. 2 is a measure of the overall length of Model 1. Also displayed are measurements that clarify the locations of the primary cuts used to create the features of this model.

FIG. 3—(FIG. 3 Front View) illustrates the appearance of Model 1 with the bottom of the Scraping Blade (2) turned down and parallel to the floor, the Scrape and Sweep Broom Handle Attachment is held at eye-level, and viewed from the front edge of the Scraping Blade. Note that the Front Securing Screw (8) can be seen protruding through the center of the Front End Cap (7). This shows how narrow broom handles are kept from sliding through the Scrape and Sweep Broom Handle Attachment. A measure of the width of Model 1 is displayed at the bottom of FIG. 3.

DETAILED DESCRIPTION OF THE INVENTION

In this document, the Scrape and Sweep Broom Handle Attachment will sometimes be referred to as the device, when discussing the form and function of its parts and physical features. In this section, a numbered Parts List and Definitions for Model 1 is given, followed by detailed instructions for producing this form of the Scrape and Sweep Broom Handle Attachment, which is known as Model 1. The number of a part in the parts list matches the number of that part in the drawing. It is the self-adjusting tubular handle, or Tubular Body (1) as it is named, that allows this cleaning tool to be attached to broom and mop handles quite easily, in the following manner: the user grips the handle of the device in the palm of their hand, holding the blade end upright, and holds the broom or mop handle upright in their other hand; then, placing the rear end of the tubular handle against the end of the broom or mop handle, the user pushes the device down onto the handle with a twisting motion until the handle cannot be inserted any further into the device. If there is a wide or oddly shaped end cap present on the broom or mop handle, then the Scrape and Sweep Broom Handle Attachment may, in most cases, be snapped onto the handle, by placing the tip of that capped handle within the open middle section or Cutout Section (5) of the Tubular Body (1) and against the rear border of the Front End Cap (7) so that the broom or mop handle and the device form a 20 degree angle. Then simply squeeze the device and the handle together, so that the Rear Section (3) of the Tubular Body snaps onto the broom or mop handle.

Parts List and Definitions for Model 1

1. Tubular Body—regarded as the handle and central component of the Scrape and Sweep Broom Handle Attachment. Although the Tubular Body is constructed from a single continuous piece of pipe, the borders of the physical features of the Tubular Body separate this part into three visibly distinct regions or sections: the Rear Section (3) the Cutout Section (5) and the Front End Cap (7). The physical features of the Tubular Body were designed specifically to provide a small degree of flexibility in the material the pipe is made of, so that the device could self-adjust to accommodate and remain attached to most standard-sized broom and mop handles. For the Model 1 proto-type, a 1 inch diameter by 6½ inches long piece of PVC pipe was used to make the Tubular Body.

2. Scraping Blade—is securely attached to the bottom surface of the Tubular Body (1) with its front edge forward and perpendicular to the length of the Tubular Body, so that the Scrape and Sweep Broom Handle Attachment can be used to scrape debris from different types of surfaces, using a forward motion. A basic handheld plastic ice scraper was used for the prototype.

3. Rear Section—is situated at the rear end of the Tubular Body (1) and is 1⅞ inches long in Model 1 of the Scrape and Sweep Broom Handle Attachment. The Rear Section features a half-inch wide slot cut through its top-center, and walls that curve outward and down from the right and left sides of the slot, which serve as semiflexible wings that grip broom and mop handles. The slot is offset by 1/16 of an inch from front to back to create a spiraling effect, which redistributes force applied to the Scraping Blade (2) so that Model 1 resists being dislodged from broom and mop handles when attached to them and used for scraping debris from surfaces.

4. Handle-gripping Wings—the curved, semiflexible, right and left sidewalls of the Rear Section (3). These Handle-gripping Wings are formed when the spiraled slot is cut in the top-center of the Rear Section. Once that piece for the slot is removed, the right and left sides of the pipe contract inward to a diameter narrower than the pipes original inside diameter. The sides may now also be flexed outward to have an outer diameter that is a measurable amount greater than the pipes original outer diameter, without breaking. The Handle-gripping Wings allow Model 1 to grab hold of and remain attached to broom and mop handles with diameters ranging from 13/16 of an inch up to 1⅛ inches wide.

5. Cutout Section—forms the middle region of the Tubular Body (1); in Model 1 it is 3 inches long. The Cutout Section has an Arcing Cut (6) at its front, which forms a border with the Front End Cap (7) and another Arcing Cut (6) at its rear, which forms a border with the Rear Section (3). The Cutout Section provides a seat for broom and mop handles and allows the user's hand to maintain contact with and control of the handles while sweeping or mopping.

6. Arcing Cuts—are ½ of an inch long, and are located at the front and rear of the Cutout Section (5). At the front of the Cutout Section, an Arcing Cut grips and supports thicker broom handles. At the rear of the Cutout Section, the other Arcing Cut helps to maintain the physical integrity of Model 1 because the Arcing Cut withstands greater force than a right-angled cut does in this area.

7. Front End Cap—helps to secure the Scrape and Sweep Broom Handle Attachment to the ends of broom and mop handles in two ways: first, the shape of the rear border of the Front End Cap causes it to flex and grip the end surfaces of wider broom and mop handles when pressure is applied to the scraping blade; 2nd, there is a post inside of the Front End Cap, near the center, which prevents narrower broom and mop handles from passing through it. The rear border of the Front End Cap is formed by an Arcing Cut (6) which also forms the front border of the Cutout Section (5). The Front End Cap is shaped with a 45 degree angle at the front end of the Tubular Body (1) which allows the Scrape and Sweep Broom Handle Attachment to be used closer to walls when scraping floors and countertops. For Model 1, the length of the Front End Cap is 1⅝ inches.

8. Front Securing Screw—can be ½ of an inch to 1 inch long and it provides two functions: first, it secures the Scraping Blade (2) to the Tubular Body (1); second, it serves as a post through the center of the Front End Cap (7) which prevents narrower broom handles from sliding all the way through the Scrape and Sweep Broom Handle Attachment.

9. Rear Securing Screw—this screw is ¼ of an inch long and it is purposely situated 1 inch from the Rear Section (3) towards the center of the Cutout Section (5) so that the head of the screw becomes a pivot point that puts pressure on the undersides of broom and mop handles, pinching them within the walls of the Tubular Body (1) and helping Model 1 stay attached to them. This screw also secures the handle of the Scraping Blade (2) to the Tubular Body (1).

Instructions for Producing Model 1

The length of Model 1 of the Scrape and Sweep Broom Handle Attachment allows it to fit well on thicker, wooden broom handles, like those common to push brooms. Model 1 also fits well on narrow broom and mop handles made of plastic or metal, which are common to household kitchen brooms and sponge mops. Construction of Model 1 begins with obtaining two items: a piece of 1 inch wide PVC pipe that is 6½ inches long, and a basic handheld plastic ice scraper with a handle that is approximately 1 inch wide, not more than ⅛ of an inch thick, and has a blade preferably 2½ inches wide. The following paragraphs provide instructions for carving the unique features of the Tubular Body (1) out of the PVC pipe, then attaching the ice scraper to the Tubular Body to serve as the Scraping Blade (2) and produce a fully functioning Scrape and Sweep Broom Handle Attachment.

First, starting in at 1⅞ inches from one end of the PVC pipe (see FIG. 2 Side View) an Arcing Cut (6) ⅝ of an inch deep and ½ of an inch long is made towards the other end of the PVC pipe. This will form one of the two Arcing Cuts (6) and will also be the border between the Rear Section (3) and the Cutout Section (5). Then, at a point parallel to the top center of that first cut and 4⅞ inches from the starting end, another Arcing Cut (6) is made into the pipe, which mirrors that first Arcing Cut (same dimensions in opposite direction). This second of the two Arcing Cuts (6) will be the border between the Cutout Section (5) and the Front End Cap (7). Continue to cut a line straight from the bottom of this second Arcing Cut towards the bottom point of the first Arcing Cut and stop once that point is reached. This creates the Cutout Section (5). This total Cutout Section (5) then measures 3 inches in length and includes the two Arcing Cuts (6) at its front and rear (see FIG. 1 and FIG. 2). Next, the Rear Section (3) is made complete by removing a 9/16 of an inch wide piece from the top-center of the Rear Section, which has been cut out by following two parallel lines that are offset by 1/16 of an inch from the front of the Rear Section (3) to the back. When this piece is removed, it creates a ½ of an inch wide spiraling slot through the top-center of the Rear Section (see FIG. 1 Top View). This spiraled slot allows the Rear Section (3) to expand and accommodate wider broom handles. The next step is to form the Front End Cap (7) that sits at the front end of the Tubular Body (1) of the Scrape and Sweep Broom Handle Attachment (see FIG. 1. FIG. 2 and FIG. 3). The Front End Cap (7) is formed by cutting a 45 degree angle from a point parallel to the top center of the second Arcing Cut (6) and 5½ inches away from the rear end of the Tubular Body (See FIG. 2 Side View) down towards the bottom of what has now become the front end of the Tubular Body. This 45 degree angled cut allows the Scraping Blade (2) of the ice scraper to reach up against the bases of walls, when the Scrape and Sweep Broom Handle Attachment is attached to the end of a broom handle and the user is in a standing position.

The last step is to attach the ice scraper to the Tubular Body (1) (see FIG. 1 Top View). Lay the ice scraper bottom-side down on a flat surface to be drilled. Then center the Tubular Body (1) bottom-side down, on top of the ice scraper. Next, drill holes straight down through both the Tubular Body (1) and the ice scraper, where the Front Securing Screw (8) and the Rear Securing Screw (9) will be inserted. Insert the screws as shown in FIGS. 1, 2, and 3: the short Rear Securing Screw (9) secures the handle end of the ice scraper to the Tubular Body (1) near the bottom-center of the Cutout Section (5); the longer Front Securing Screw (8) secures the front end of the ice scraper to the Tubular Body (1) at the center of the Front End Cap (7). Securely attach the ice scraper to the Tubular Body (1) by tightening one hex nut onto each screw. The Front Securing Screw (8) also prevents narrower broom and mop handles from sliding through the Scrape and Sweep Broom Handle Attachment, when it is attached to them and used for scraping.

In conclusion, the Scrape and Sweep Broom Handle Attachment is superior to previously produced handheld scrapers and broom handle attachments because of its self-adjusting tubular handle, also known as the Tubular Body. The particular design of this tubular handle and the way the separate parts of the Scrape and Sweep Broom Handle Attachment function together, allow it to be simply slid or snapped on to different broom or mop handles with diameters that range from narrow to wide, and can remain attached to them without having to modify the broom or mop handles, and without having those handles originally created with threaded ends to screw into the device, or having holes drilled into them for the insertion of pins or screws to hold the device in place, and without using any adhesives or other types of fasteners to hold the device in place, so that the Scrape and Sweep Broom Handle Attachment may be simply slid or snapped on to the ends of broom and mop handles to be used as a long-handled scraper, then easily slid off to be used as a handheld scraper whenever the longer handle gets in the way or is ineffective.

The invention claimed is:

1. A scraper attachment adapted for attachment to an end of a handle of a cleaning implement, the scraper attachment comprising:

an elongate one-piece body comprising a tubular portion at a front portion of the elongate one-piece body;

a pair of arcuate wings at a rear portion of the elongate one-piece body, free ends of the pair of arcuate wings defining a space between the pair of arcuate wings which permit the pair of arcuate wings to outwardly deflect away from the space; and an elongate cut-out portion between the tubular portion and the pair of arcuate wings, an intersection of the cut-out portion and the tubular portion and the pair of arcuate wings including an arcuate region in order to improve strength of the elongate one-piece body; and a substantially elongate planar blade defining a scraping edge at an end thereof, the substantially elongate planar blade being secured to the elongate one-piece body by at least one fastening member such that the scraping edge of the substantially elongate planar blade is adjacent to and forward of the tubular portion of the elongate one-piece body at the front portion thereof;

wherein the end of the handle of the cleaning implement is configured to be inserted into the tubular portion at the front portion of the elongate one-piece body and then lowered toward the pair of arcuate wings at the rear portion of the elongate one-piece body at which point the pair of arcuate wings deflect outward so that the handle of the cleaning implement is configured to be securely attached to the elongate one-piece body between the pair of arcuate wings.

* * * * *